US006035470A

United States Patent [19]

Chow

[11] Patent Number: 6,035,470

[45] Date of Patent: Mar. 14, 2000

[54] WATERBED WITH AN AIR BAG TUBE HAVING A POSITIONING PIECE

[76] Inventor: Andy Chow, 4F, No.27, Lane 20, Hsing Tung Street, Taipei, Taiwan

[21] Appl. No.: 09/188,697

[22] Filed: Nov. 10, 1998

[30] Foreign Application Priority Data

Nov. 13, 1997 [TW] Taiwan ..... 86219021

[51] Int. Cl.[7] ..... A47C 27/10

[52] U.S. Cl. ..... 5/687; 5/669; 5/682

[58] Field of Search ..... 5/687, 682, 669, 5/665

[56] References Cited

U.S. PATENT DOCUMENTS

| | | | |
|---|---|---|---|
| 4,310,936 | 1/1982 | Benjamin | 5/687 |
| 5,669,091 | 9/1997 | Chung | 5/687 |
| 5,727,269 | 3/1998 | Chung | 5/682 |
| 5,794,287 | 8/1998 | Chung | 5/687 |
| 5,845,353 | 12/1998 | Chow | 5/687 |

*Primary Examiner*—Alexander Grosz
*Attorney, Agent, or Firm*—Rosenberg, Klein & Lee

[57] ABSTRACT

A waterbed system is provided. The waterbed system comprises a water fillable bed mattress, a plurality of transverse partitions, an air bag unit, and a bed protecting cover. The plurality of transverse partitions serve to dissipate the water disturbances caused by the weight and movement of a user, and enhance the stability and structural integrity of the mattress when filled with water. Those portions of the water fillable bed mattress at which components are joined are thus subjected to less pressure and stress and, consequently, the threat of water leakage is minimized. In certain embodiments, at least one longitudinal partition is also disposed within the water fillable mattress to isolate water disturbances in one set of transverse partitions from propagating to another set of transverse partitions, if any. The longitudinal partition is formed with water openings spaced in offset manner. The air bag unit is adapted to receive pressurized air whereby the firmness of the water fillable bed mattress may be adjusted.

18 Claims, 5 Drawing Sheets

WATERBED WITH AN AIR BAG TUBE HAVING A POSITIONING PIECE

BACKGROUND OF THE INVENTION

1. Field of the Invention

The present invention relates to an improved structure of a waterbed, especially to a waterbed structure with greater stability and less prone to undulations, the firmness of which can be adjusted as desired to be highly adaptable. The present invention relates further to a waterbed structure having great durability and great resistance to the leakage of water therefrom.

2. Description of the Prior Art

Fused portions in prior art waterbeds generally, and particularly in prior art waterbeds with air circulating cushion flanges, are formed by thermal welding at high frequency. Such beds are easily disturbed and deformed by the weights and movements of users. Thus, the waterbed exhibits poor stability, and the pressure of the water generated therein tends to compromise over time the high frequency thermal welded fused portions, leading to the leakage of water form the waterbed. Furthermore, such prior art waterbeds cannot effectively maintain a firm shape. The bed, therefore, easily deforms, permitting the loosening of material components and diminishing the durability of the high frequency thermal welded fused portions.

SUMMARY OF THE INVENTION

Accordingly, the object of the present invention is to provide an improved structure of a waterbed, wherein by installing a plurality of transverse partitions, the undulations and disturbances of the water due to the weight and movement of the user are diminished. By the present invention, the stability and structural integrity of the water fillable bed mattress is increased. The high frequency thermal welded fused portions of the water fillable bed mattress are subjected to less pressure. Thus, compromise of the fused portions is less likely, as is the potential leakage of water.

Another object of the present invention is to provide an improved structure of a waterbed, wherein a longitudinal partition is installed in an intermediate portion of the water fillable bed mattress so as to isolate and dissipate the transverse undulations and disturbances of the water from the left and right sides, and thereby further enhance the stability of the water fillable bed mattress. In order to sustain the durability of the fused portions, the longitudinal partition is installed with water openings for releasing the pressure of the water flow. These openings are disposed in offset manner at the left and right sides.

A further object of the present invention is to provide an improved structure of a waterbed, wherein a firm bed protecting cover may be further added externally about the water fillable bed mattress. The bed protecting cover has the effect of reinforcing a firm configuration for the water fillable bed mattress, so that the bed will not deform and its material components will not be loosened. The fused portions formed by high frequency thermal welding may endure for a very long time without permitting water leakage. This bed protecting cover has in addition to the function of fixing the water filling bed mattress configuration the function of reducing the undulations/disturbance propagations in the bed. Hence, the bed protecting cover has the function of stabilizing the fillable bed mattress while resisting the leakage of water due to aging of the bed.

Another object of the present invention is to provide an improved structure of a waterbed, wherein air is pumped into the air bag unit installed in the water fillable bed mattress to guide the air into a plurality of air bag tubes. Therefore, the firmness of the water fillable bed mattress can be adjusted by air pressure, and the preferences of different users can be satisfied.

BRIEF DESCRIPTION OF THE DRAWINGS

The present invention will be better understood and its numerous objects and advantages will become apparent to those skilled in the art by referencing the following drawings in which.

DETAILED DESCRIPTION OF THE PREFERRED EMBODIMENTS

Figure 1:
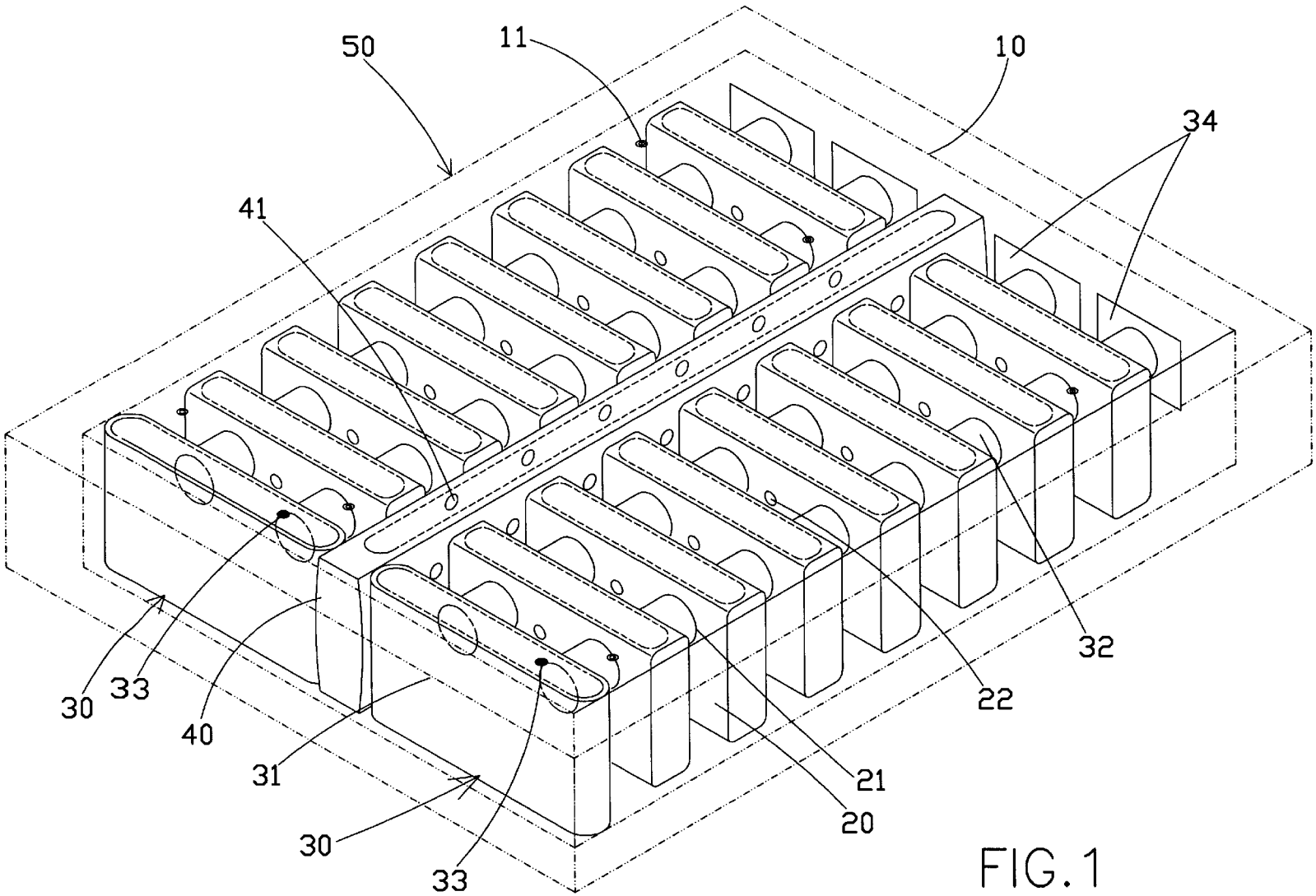
FIG. 1 is a schematic perspective view of one embodiment of the present invention.
Figure 2:
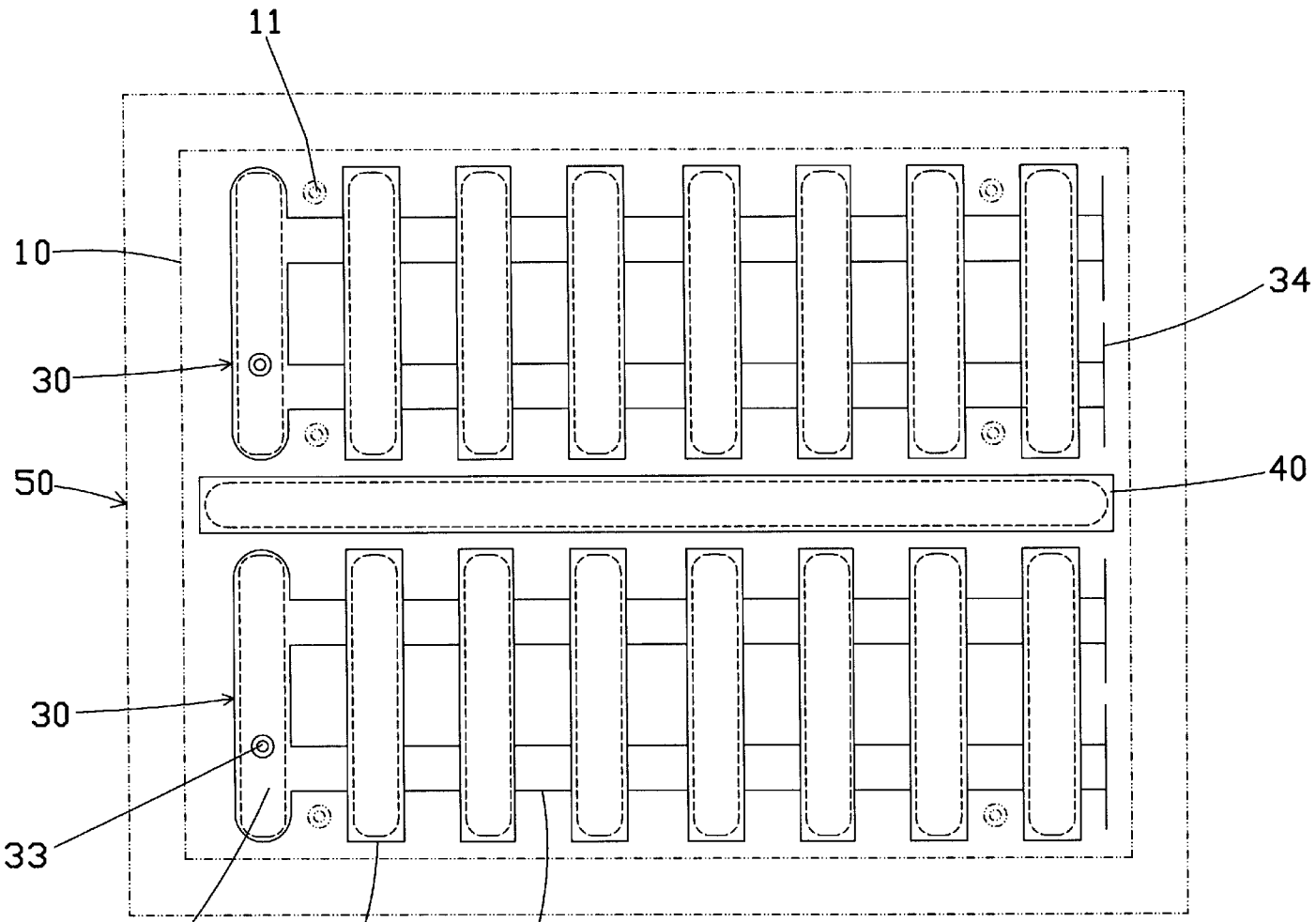
FIG. 2 is a schematic elevational view of one embodiment of the present invention.
Figure 3:
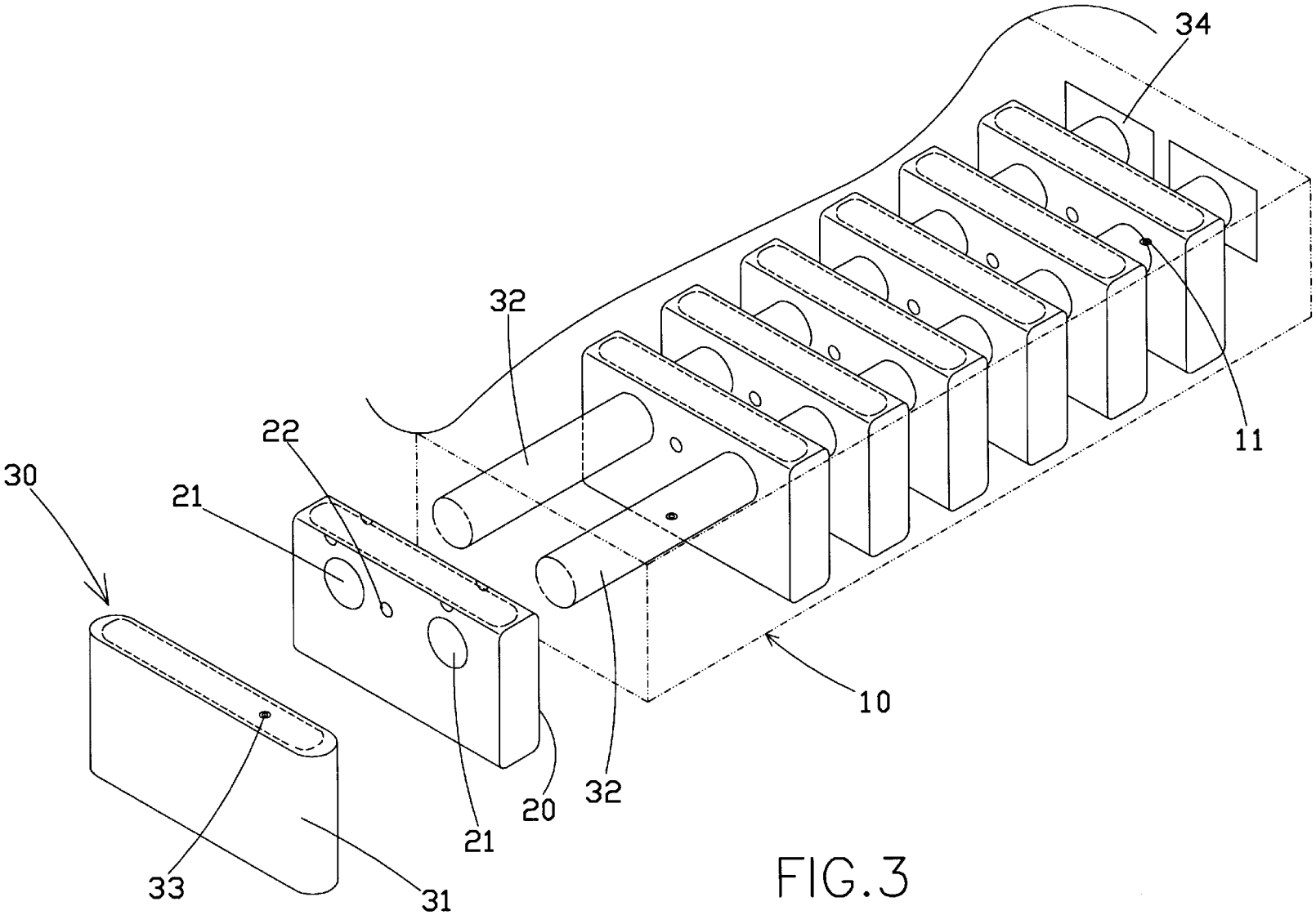
FIG. 3 is a partial perspective view of one embodiment of the present invention.

With reference to FIGS. 1–3, the schematic perspective view, the elevational schematic view, and the partial perspective view of one embodiment of the present invention are shown. The improved structure of a waterbed of the present invention contains a water fillable bed mattress 10, a plurality of transverse partitions 20, an air bag unit 30, and a bed protecting cover 50. If the bed is to be wider, it may be selectively formed with a longitudinal partition 40. The water fillable bed mattress 10 is formed with at least one water inlet 11 in order that the user can introduce water into the bed mattress 10.

A plurality of transverse partitions 20 formed of PVC or other material are disposed within the water fillable bed mattress 10. If the bed is a two person bed (larger size), then the transverse partitions may be disposed at the left and right sides thereof. Each transverse partition 20 is configured as a hollow strip, the transversal direction thereof having a hollow shape. It is formed on its longitudinal surfaces with a plurality of round holes 21 and water openings 22. The top end and lower end of the transverse partitions 20 are joined to the inner wall of the water fillable bed mattress 10 by high frequency thermal welding.

The air bag unit 30 is installed within the water bed mattress 10 coupled to the transverse partitions 20. The air bag unit 30 has an air bag cavity portion 31 and a plurality of air bag tubes 32. The air bag cavity portion 31 is installed on one end within the water fillable bed mattress 10. At least one air inlet 33 is formed on the air bag cavity portion 31. The air inlet 33 projects from the water fillable bed mattress 10 in order that the user may conveniently pump air into the air bag cavity portion 31. The air bag cavity portion 31 communicates with a plurality of air bag tubes 32. The air bag tubes 32 pass through the round holes 21 of a plurality of transverse partitions 20. The distal end of each air bag tube 32 is joined to a large positioning piece 34 by high frequency thermal welding so that the air bag tubes do not separate from the transverse partition 20 on the bed end.

If the bed is to be a single person bed, then the waterbed structure of the present invention may be formed with a water fillable bed mattress 10 wherein one set of transverse partitions 20 and one air bag unit 30 are disposed. If the bed is to be a two or more person bed, then it is formed with at least left and right side sets of transverse partitions 20 (as shown in FIGS. 1 and 2) and at least two air bag units 30. The waterbed structure of the present invention is formed in that case by a water fillable bed mattress 10, two sets of the transverse partitions 20, and two sets of air bag units 30. Also, a longitudinal partition 40 may be installed between the left and right side sets of transverse partitions 20.

The longitudinal partition 40 is formed of PVC or other material, and has a hollow long strip configuration. The surface of the longitudinal partition 40 is formed with a plurality of water openings 41. The top end and lower end of the longitudinal partition 40 is joined to the inner wall of the water fillable bed mattress 10 by high frequency thermal welding.

Figure 4:
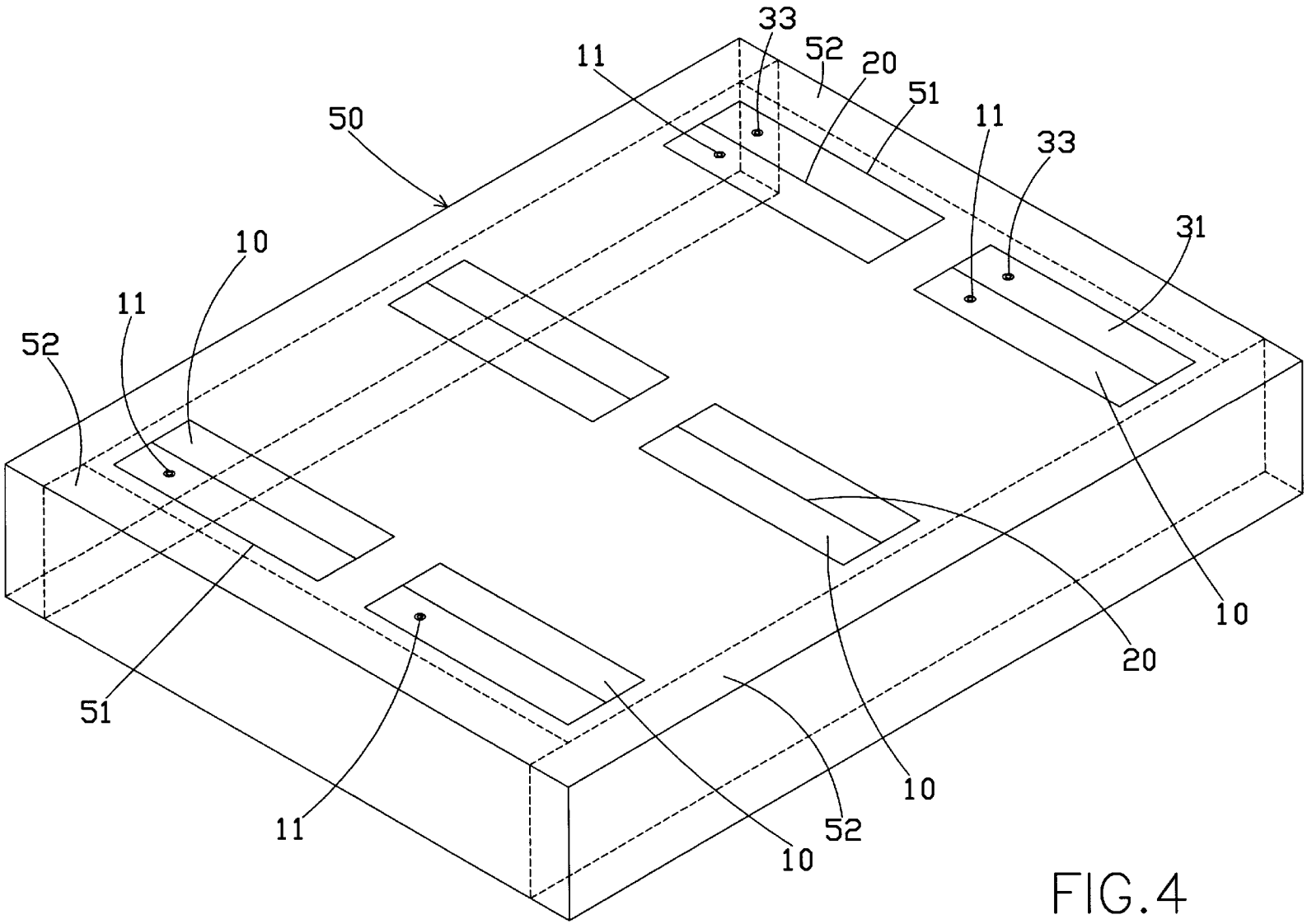
FIG. 4 is a schematic view of the bed protecting cover of a two person bed embodiment of the present invention; and, FIG. 5 is a schematic view of the bed protecting cover of a one person bed embodiment of the present invention.
Figure 5:
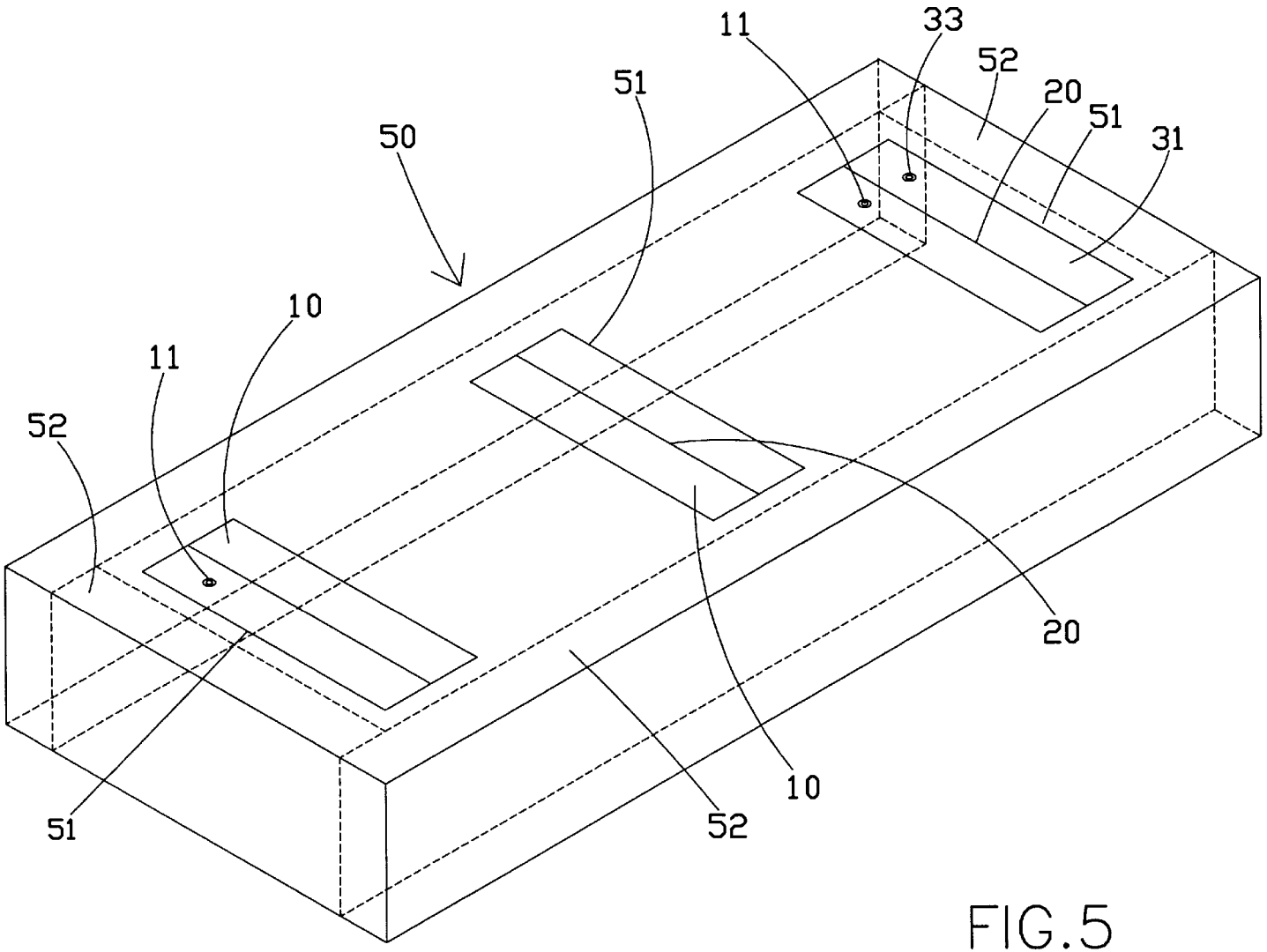

Further, a firm bed protecting cover 50 may be further added externally to the water fillable bed mattress 10. The bed protecting cover 50 may be varied in configuration in accordance with the intended size and configuration of the bed (single person bed or double person bed, as shown in FIGS. 5 and 4). A long strip sponge 52 or other similar material may be arranged within the bed protecting cover 50. On the surface of the bed protecting cover 50 are formed a plurality of oblong holes 51 that provide sufficient access for installing the bed mattress 10 therein. Also, the bed protecting cover 50 has the effect of reinforcing a firm shape for the water fillable bed mattress 10 so that the bed will not deform, and material components thereof will not be loosened. The fused portions formed by high frequency welding may thus endure for a very long time to prevent leakage of the water. This bed protecting cover 50 has the function of structurally reinforcing the water fillable bed mattress and reducing the propagation of disturbances through the bed. Also, one or more fastening/adhesion strips or zippers (not shown) may be installed on the periphery of the bed protecting cover 50 so that a thin bed pad or other medical or health-related bed pad may be selectively employed with the bed.

In accordance with the present invention, the plurality of transverse partitions 20 serve to dissipate the propagation of undulations or disturbances of the water resulting from the compressing weight and movements of the user. By the present invention, the stability of the water fillable bed mattress is increased. The high frequency fused portions of the water fillable bed mattress are better preserved to prevent water leakage. Further in accordance with the present invention, a longitudinal partition 40 may be disposed in an intermediate portion of the water fillable bed mattress 10 in order to isolate the transversal propagation of water undulations/disturbances in the left and right side compartments and thereby stabilize the water fillable bed mattress' structure. In order to optimize the durability of the fused portions formed by high frequency thermal welding, the longitudinal partition 40 is formed with water openings 41 positioned in offset manner at the left and right sides for releasing the pressure of the water flow. Moreover, air pumped into the air inlet 33 at the air bag cavity portion 31 is guided into a plurality of air bag tubes 32. This enables the firmness of the water fillable bed mattress 10 to be adjusted by air pressure. Thus, the personal preferences of different users may be satisfied. In addition, a long strip sponge or other material 52 with similar properties may be disposed at the periphery of the bed protecting cover 50 to further reinforce the water fillable bed mattress. If the waterbed is formed with flexible yet firm materials, then the long strip sponge or other similar material 52 at the periphery of the bed may be omitted, and cover 50 may be realized as a simple bed protecting cover suited to the given market demands.

Therefore, the improved bed structure of the present invention substantially overcomes numerous shortcomings in the prior art, including the ability to resist undulations, instability, leakage of water, lack of firmness (harmful to the user's backbone), and lack of structural integrity.

Although the present invention has been described using specific embodiments thereof, the exemplary embodiments described are meant to be illustrative only and not restrictive in nature. It is clear that many other variations would be possible without departing from the spirit and scope of the present invention defined in the appended claims.

What is claimed is:

1. A waterbed system comprising:

(a) a water fillable mattress extending in a longitudinal direction and having an inlet, said water fillable mattress having an internal compartment defined by an inner wall;

(b) at least one transverse partition set disposed within said internal compartment of said water fillable mattress, said transverse partition set including a plurality of spaced transverse partitions each extending substantially in a direction transverse to said longitudinal direction, each said transverse partition having an outer surface joined respectively at upper and lower ends thereof to opposing portions of said inner wall of said water fillable mattress, each said transverse partition defining a transverse inner chamber communicating with said internal compartment through a plurality of water openings formed in said outer surface thereof;

(c) at least one air bag unit disposed within said internal compartment and having an air inlet, said air bag unit including an air bag cavity portion, a plurality of air bag tubes extending from said air bag cavity portion, said air bag tubes each engaging a plurality of said transverse partitions of said transverse partition set, said air bag unit including at least one positioning piece joined to at least one said air bag tube adjacent a terminal end thereof for securing said engagement with said transverse partitions; and, (d) a bed protecting cover disposed about said water fillable mattress, said bed protecting cover having formed therein a plurality of access holes to said water fillable mattress.

2. The waterbed system as recited in claim 1 wherein said bed protecting cover includes an elongate strip member for reinforcing said water fillable mattress.

3. The waterbed system as recited in claim 2 wherein said strip member of said bed protecting cover is formed of a resilient material.

4. The waterbed system as recited in claim 1 comprising at least a pair of said transverse partition sets disposed within said internal compartment of said water fillable mattress.

5. The waterbed system as recited in claim 4 wherein further comprising at least one longitudinal partition disposed within said internal compartment of said water fillable mattress and extending longitudinally between a pair of said transverse partition sets, said longitudinal partition having an outer surface joined respectively at upper and lower ends thereof to opposing portions of said inner wall of said water fillable mattress, said longitudinal partition defining a longitudinal inner chamber communicating with said internal compartment through a plurality of water openings formed in said outer surface thereof.

6. The waterbed system as recited in claim 5 wherein said water openings formed in said longitudinal partition are disposed offset in said longitudinal direction one from the other.

7. The waterbed system as recited in claim 1 wherein high frequency thermally welded joints are formed between said joined elements thereof.

8. The waterbed system as recited in claim 1 wherein each said air bag tube is received through each said transverse partition of at least one said transverse partition set.

9. The waterbed system as recited in claim 1 wherein said outer surface of each of said transverse partitions includes a pair of longitudinally opposed panels, a plurality of said water openings being formed in said panels.

10. A waterbed system comprising:

(a) a water fillable mattress extending in a longitudinal direction and having an inlet, said water fillable mattress having an internal compartment defined by an inner wall;

(b) at least one transverse partition set disposed within said internal compartment of said water fillable mattress, said transverse partition set including a plurality of spaced transverse partitions each extending substantially in a direction transverse to said longitudinal direction, each said transverse partition having an outer surface joined respectively at upper and lower ends thereof to opposing portions of said inner wall of said water fillable mattress, each said transverse partition defining a transverse inner chamber communicating with said internal compartment through a plurality of water openings formed in said outer surface thereof;

(c) at least one air bag unit disposed within said internal compartment and having an air inlet, said air bag unit including an air bag cavity portion, a plurality of air bag tubes extending from said air bag cavity portion, said air bag tubes matingly engaging a plurality of said transverse partitions of said transverse partition set, said air bag unit including at least one positioning piece joined to at least one said air bag tube adjacent a terminal end thereof for securing said engagement with said transverse partitions; and, (d) a bed protecting cover disposed about said water fillable mattress, said bed protecting cover having formed therein a plurality of access holes to said water fillable mattress, said bed protecting cover including an elongate strip member for reinforcing said water fillable mattress.

11. The waterbed system as recited in claim 10 wherein said strip member of said bed protecting cover is formed of a resilient material.

12. The waterbed system as recited in claim 10 comprising at least a pair of said transverse partition sets disposed within said internal compartment of said water fillable mattress.

13. The waterbed system as recited in claim 12 wherein further comprising at least one longitudinal partition disposed within said internal compartment of said water fillable mattress and extending longitudinally between a pair of said transverse partition sets, said longitudinal partition having an outer surface joined respectively at upper and lower ends thereof to opposing portions of said inner wall of said water fillable mattress, said longitudinal partition defining a longitudinal inner chamber communicating with said internal compartment through a plurality of water openings formed in said outer surface thereof.

14. The waterbed system as recited in claim 10 wherein high frequency thermally welded joints are formed between said joined elements thereof.

15. The waterbed system as recited in claim 10 wherein said outer surface of each of said transverse partitions includes a pair of longitudinally opposed panels, a plurality of said water openings being formed in said panels.

16. A waterbed system comprising:

(a) a water fillable mattress extending in a longitudinal direction and having an inlet, said water fillable mattress having an internal compartment defined by an inner wall;

(b) at least a pair of transverse partition sets disposed within said internal compartment of said water fillable mattress, each said transverse partition set including a plurality of spaced transverse partitions each extending substantially in a direction transverse to said longitudinal direction, each said transverse partition having an outer surface joined by high frequency thermal welding respectively at upper and lower ends thereof to opposing portions of said inner wall of said water fillable mattress, each said transverse partition defining a transverse inner chamber communicating with said internal compartment through a plurality of water openings formed in said outer surface thereof;

(c) at least one air bag unit disposed within said internal compartment and having an air inlet, said air bag unit including an air bag cavity portion, a plurality of air bag tubes extending from said air bag cavity portion, said air bag tubes each matingly engaging a plurality of said transverse partitions of said transverse partition set, said air bag unit including at least one positioning piece joined by high frequency thermal welding to at least one said air bag tube adjacent a terminal end thereof for securing said engagement with said transverse partitions;

(d) at least one longitudinal partition disposed within said internal compartment of said water fillable mattress and extending longitudinally between a pair of said transverse partition sets, said longitudinal partition having an outer surface joined by high frequency thermal welding respectively at upper and lower ends thereof to opposing portions of said inner wall of said water fillable mattress, said longitudinal partition defining a longitudinal inner chamber communicating with said internal compartment through a plurality of water openings formed in said outer surface thereof; and, (e) a bed protecting cover disposed about said water fillable mattress, said bed protecting cover having formed therein a plurality of access holes to said water fillable mattress, said bed protecting cover including an elongate strip member for reinforcing said water fillable mattress.

17. The waterbed system as recited in claim 16 wherein said outer surface of each of said transverse partitions includes a pair of longitudinally opposed panels, a plurality of said water openings being formed in said panels.

18. The waterbed system as recited in claim 16 wherein said strip member of said bed protecting cover is formed of a resilient material.

* * * * *